US006273172B1

(12) United States Patent
Frey

(10) Patent No.: US 6,273,172 B1
(45) Date of Patent: Aug. 14, 2001

(54) MOTOR OPERATED AWNING

(75) Inventor: Sydney Frey, deceased, late of Brookfield, WI (US), by Pat Frey, legal representative of Sydney Frey

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/361,537

(22) Filed: Jul. 27, 1999

Related U.S. Application Data

(63) Continuation-in-part of application No. 09/137,201, filed on Aug. 20, 1998, now Pat. No. 6,095,221.

(51) Int. Cl.[7] ..... E04F 10/06
(52) U.S. Cl. ..... 160/67; 160/69; 135/88.12
(58) Field of Search ..... 160/65, 66, 67, 160/68, 69, 70, 72, 73, 78, 79, 81, 59; 135/88.11, 88.12

(56) References Cited

U.S. PATENT DOCUMENTS

| | | | | |
|---|---|---|---|---|
| 328,921 | | 10/1885 | Cook . | |
| 415,102 | | 11/1889 | Fullerton . | |
| 500,741 | | 7/1893 | Giessenbier . | |
| 602,772 | | 4/1898 | Richards . | |
| 918,598 | | 4/1909 | Rothchild . | |
| 924,951 | | 6/1909 | Winberg . | |
| 1,246,601 | | 11/1917 | Howe . | |
| 1,620,958 | | 3/1927 | Girton et al. . | |
| 1,742,437 | | 1/1930 | Davenport . | |
| 1,854,499 | * | 4/1932 | Anton et al. | 160/65 |
| 1,856,161 | * | 5/1932 | Heiser | 160/70 |
| 1,865,083 | | 6/1932 | Christian . | |
| 1,977,114 | | 10/1934 | Chitwood . | |
| 1,980,991 | * | 11/1934 | Gronbech | 160/72 |
| 2,107,676 | | 2/1938 | Neumann . | |
| 3,722,571 | * | 3/1973 | Knight et al. | 160/68 |
| 3,847,171 | | 11/1974 | Akers et al. . | |
| 4,160,458 | | 7/1979 | Marcellus . | |
| 4,180,117 | * | 12/1979 | Greer . | |
| 4,411,348 | * | 10/1983 | Fillion | 160/310 |
| 4,615,371 | | 10/1986 | Clauss . | |
| 4,623,132 | | 11/1986 | Smith . | |
| 4,719,954 | * | 1/1988 | Curtis et al. | 160/57 |
| 4,836,263 | | 6/1989 | Ament . | |

(List continued on next page.)

FOREIGN PATENT DOCUMENTS

| | | | |
|---|---|---|---|
| 582427 | * | 9/1938 | (DE) . |
| 27 36 721 | | 2/1978 | (DE) . |
| 55187 | * | 9/1938 | (DK) . |
| 2 050 154 | | 1/1981 | (GB) . |
| 7703999 | | 4/1977 | (NL) . |

*Primary Examiner*—Blair M. Johnson
(74) *Attorney, Agent, or Firm*—Pearne & Gordon LLP

(57) ABSTRACT

An automatic retractable awning assembly includes a roller, a flexible canopy rollable on the roller and having an inner edge for connection to a wall and an outer edge secured to the roller, a torsion spring operably connected to a first end of the roller to bias the roller to roll the canopy onto the roller, a pair of arm assemblies supporting opposite ends of the roller and operable to move the roller between a retracted position adjacent the wall and an extended position spaced from the wall, and an electric motor operably connected to a second end of the roller with a gear train to selectively rotate the roller in either direction. Each of the arm assemblies include a vertically extending base arm for connection to the wall, a bottom arm having a first end pivotally connected to the base arm, an extended arm having a first end pivotally connected to the bottom arm and a second end connected to and supporting the roller, a top arm having a first end pivotally connected to the base arm above the bottom arm and a second end pivotally connected to the extended arm, and a gas compression spring extending between the base arm and the top arm for outwardly biasing the arm assembly toward the extended position.

30 Claims, 10 Drawing Sheets

U.S. PATENT DOCUMENTS

| | | | | |
|---|---|---|---|---|
| 4,862,940 | * | 9/1989 | Atchison | 160/67 |
| 5,148,848 | | 9/1992 | Murray et al. . | |
| 5,292,169 | | 3/1994 | O'Brian . | |
| 5,307,856 | | 5/1994 | Murray . | |
| 5,369,919 | | 12/1994 | Lohausen . | |
| 5,597,006 | | 1/1997 | Simonetti . | |
| 5,799,716 | * | 9/1998 | Yamaguchi et al. | 160/310 |
| 5,813,424 | | 9/1998 | Simonetti . | |

* cited by examiner

FIG. 1
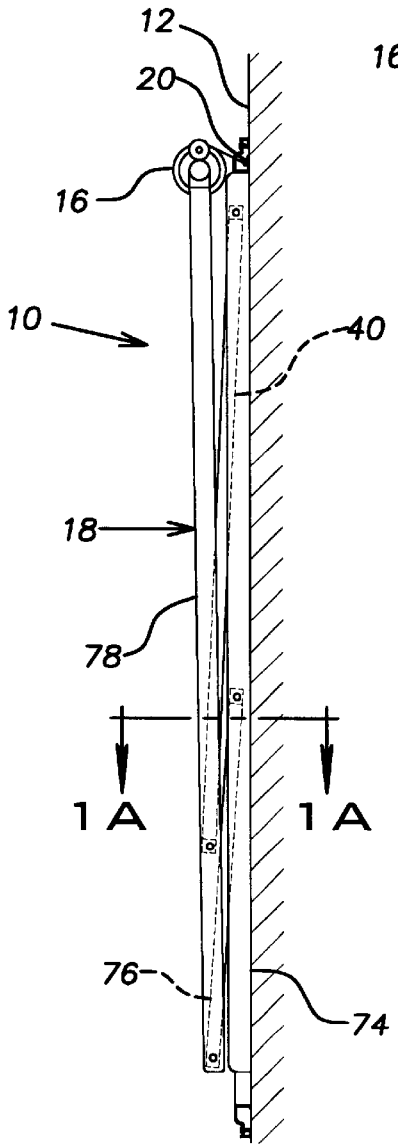
FIG. 2
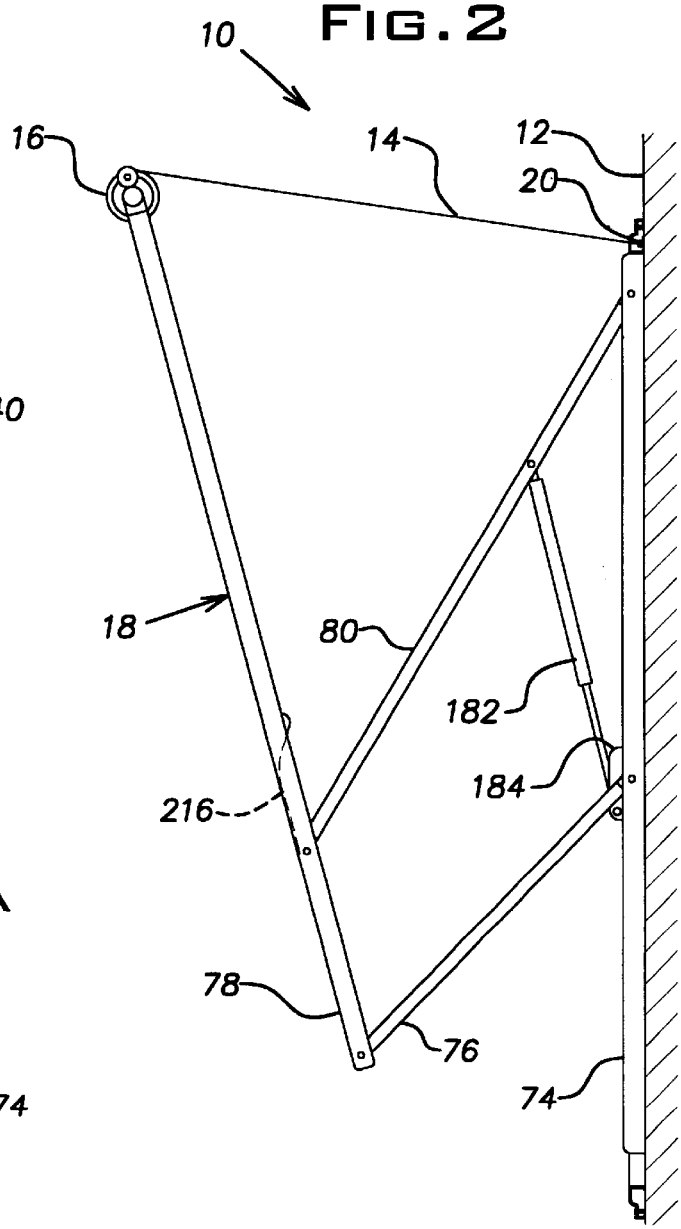
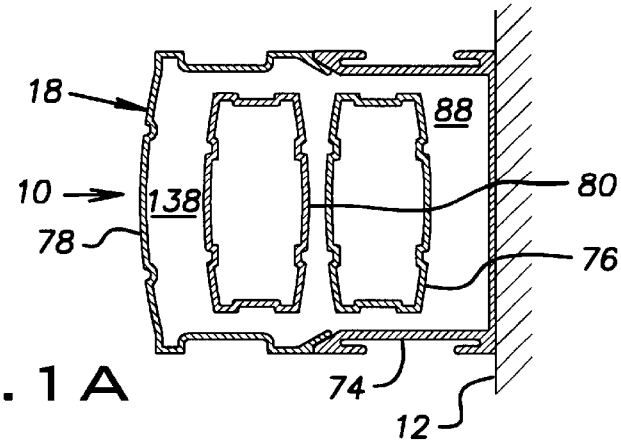
FIG. 1A

FIG. 11
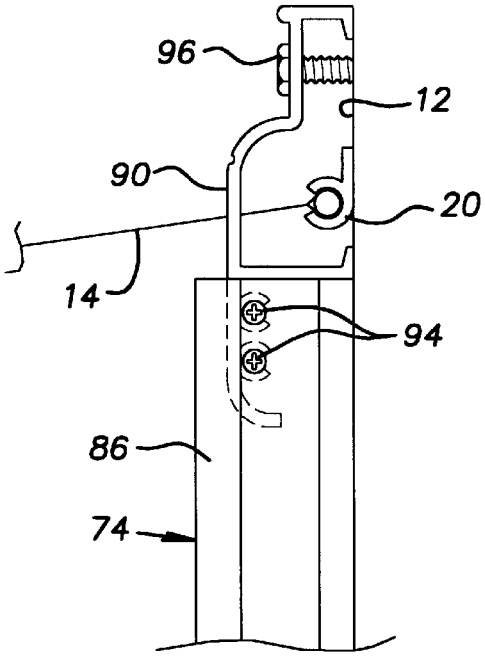
FIG. 12
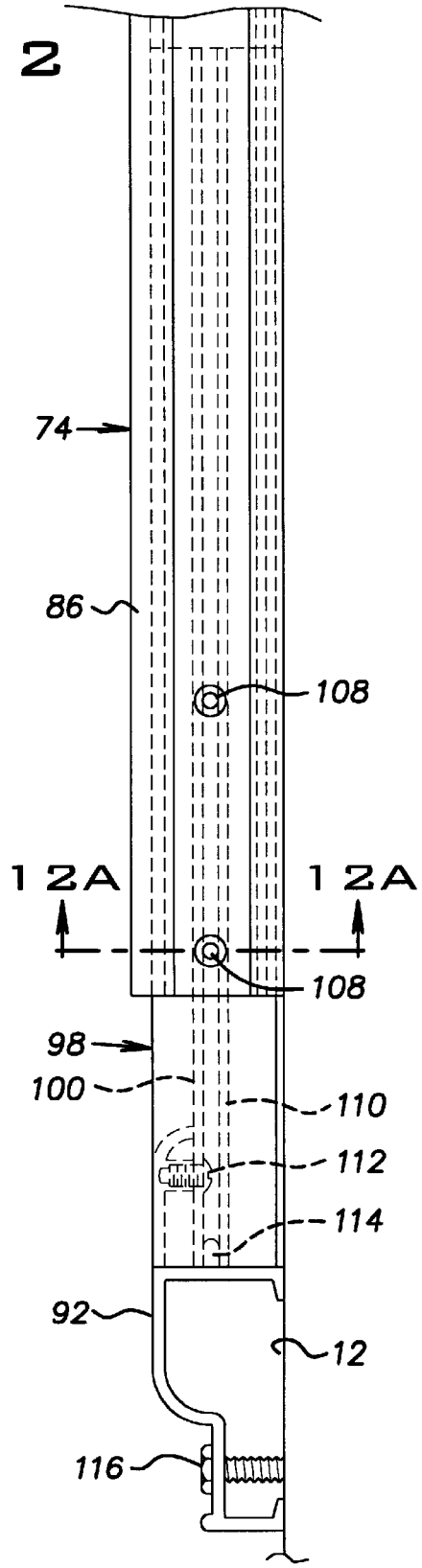
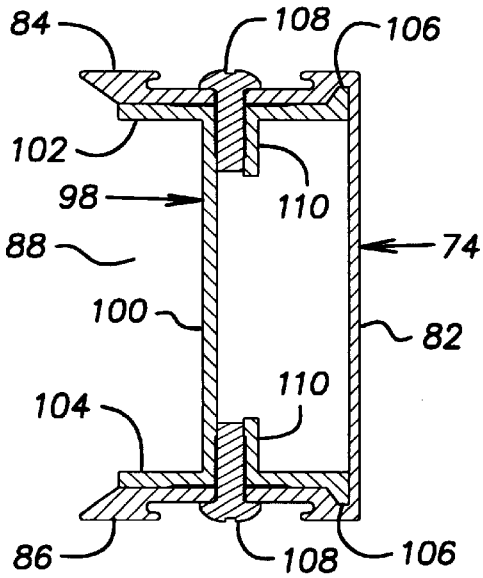
FIG. 12A

FIG. 13
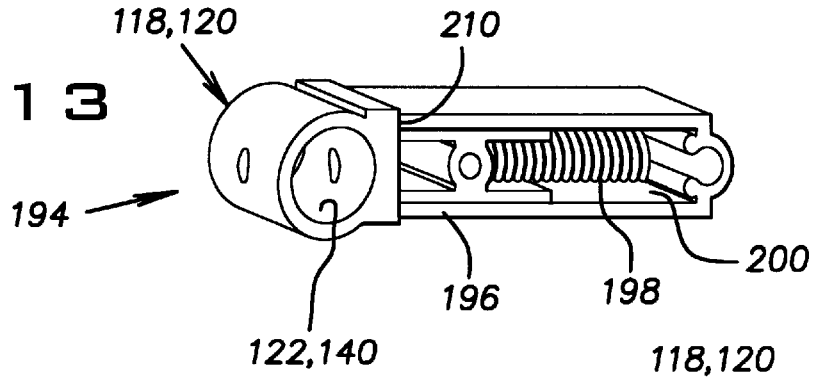
FIG. 14
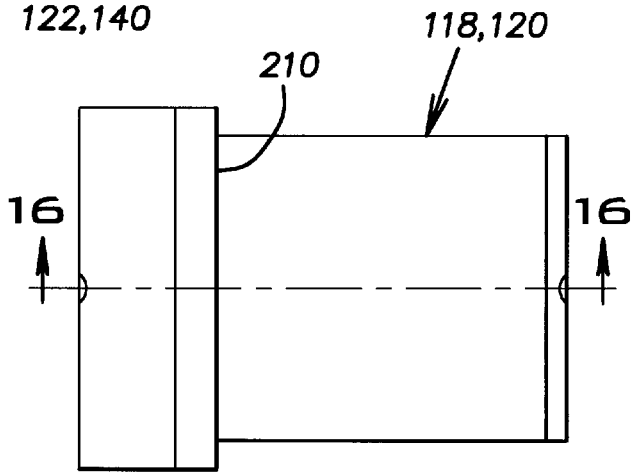
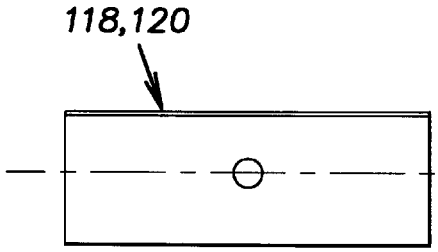
FIG. 15
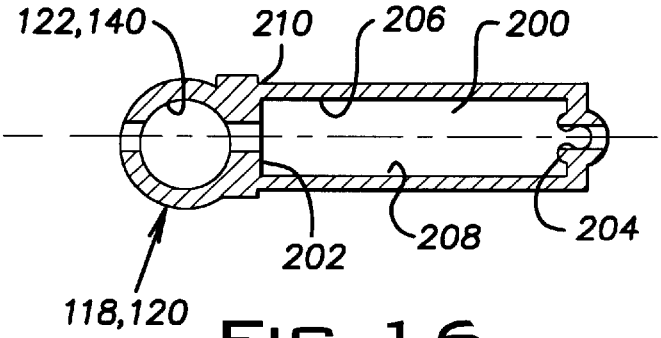
FIG. 16
FIG. 17
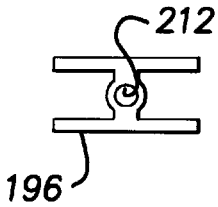
FIG. 18
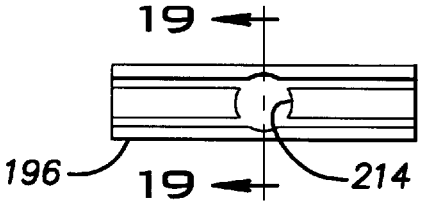
FIG. 19
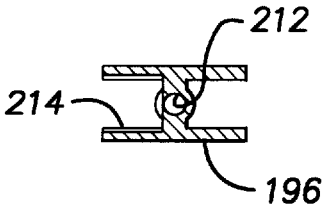

MOTOR OPERATED AWNING

This application is a continuation-in-part of U.S. application Ser. No. 09/137,201 filed on Aug. 20, 1998, U.S. Pat. No. 6,095,221.

BACKGROUND OF THE INVENTION

The present invention generally relates to retractable awnings of the type to be mounted to a substantially vertical support surface and, more specifically, to such awnings which have powered automatic operation.

There are a number of known retractable awnings that support an awning or canopy to create a sheltered area. An inner end of the canopy is typically secured to a wall and an outer end of the canopy is typically secured to a roller assembly. The roller assembly is supported at its ends by support arms for movement between a retracted position, wherein the roller assembly is disposed adjacent the wall, and an extended position, wherein the roller assembly is extended out away from the wall. When the roller assembly is in the retracted position, the canopy is rolled-up on the roller assembly. When the roller assembly is in the extended position, the canopy is unrolled from the roller assembly and extends between the wall and the roller assembly. These retractable awnings are often designed for use with movable support structures such as, for example, recreational vehicles, travel trailers, mobile homes, and the like, but are also usable with fixed structures.

While these prior awning assemblies may adequately perform their intended functions, they are often difficult to deploy and retract due to their heavy weight, complex operation and numerous operational steps, particularly for elderly and physically challenged individuals. There have been attempts to develop powered automatic awnings in order to overcome these problems.

For example, U.S. Pat. Nos. 3,847,171 and 4,160,458 disclose retractable awnings automatically operated by electric motors and U.S. Pat. Nos. 5,597,006 and 5,813,424 disclose retractable awnings automatically operated by pneumatic actuators. While these automatic awnings may some what improve operation, they still may be relatively difficult to operate, difficult and expensive to manufacture or repair, and/or unreliable in the field. Accordingly, there is a need in the art for an improved retractable awning which has powered automatic operation.

BRIEF SUMMARY OF THE INVENTION

The present invention provides a powered automatic retractable awning which overcomes at least some of the above-noted problems of the related art. According to the present invention, a retractable awning assembly includes a roller, a flexible canopy rollable onto the roller and having an inner edge for connection to a wall and an outer edge secured to the roller, and a pair of arm assemblies supporting opposite ends of the roller and operable to move the roller between a retracted position adjacent the wall and an extended position spaced from the wall. The awning assembly further includes a first spring biasing the roller to roll the canopy onto the roller, at least one second spring biasing the arm assemblies toward the extended position, and an electric motor operable to rotate the roller in either direction.

According to another aspect of the present invention, a retractable awning assembly includes a roller, a flexible canopy rollable on the roller and having an inner edge for connection to a wall and an outer edge secured to the roller, a pair of arm assemblies supporting opposite ends of the roller and operable to move the roller between a retracted position adjacent the wall and an extended position spaced from the wall, and an electric motor operable to rotate the roller in either direction. Each of the arm assemblies include a vertically extending base arm for connection to the wall, a bottom arm having a first end pivotally connected to the base arm, an extended arm having a first end pivotally connected to the bottom arm and a second end connected to and supporting the roller, a top arm having a first end pivotally connected to the base arm above the bottom arm and a second end pivotally connected to the extended arm, and a spring extending between the base arm and one of the bottom arm and the top arm for outwardly biasing the bottom arm, the extended arm, and the top arm toward the extended position.

BRIEF DESCRIPTION OF THE SEVERAL VIEWS OF THE DRAWING

These and further features of the present invention will be apparent with reference to the following description and drawings, wherein:

FIG. 1 is a side elevational view of a retractable awning assembly according to the present invention near a stored or retracted position;

FIG. 1A is an enlarged cross-sectional view taken along line 1A—1A of FIG. 1;

FIG. 2 is a side elevational view of the retractable awning assembly of FIG. 1 in a partially deployed or extended position;

FIG. 11 is an enlarged side elevational view of the upper end of a base arm of the retractable awning assembly of FIGS. 1–3;

FIG. 12 is an enlarged side elevational view of the lower end of a base arm of the retractable awning assembly of FIGS. 1–3;

FIG. 12A is an enlarged cross-sectional view taken along line 12A—12A of FIG. 12;

FIG. 13 is an enlarged perspective view of an adjustable-force end cap assembly of FIGS. 9 and 10;

FIG. 14 is a side view of an end cap of the adjustable end cap assembly of FIG. 13;

FIG. 15 is an end view of the end cap of FIG. 14;

FIG. 16 is a cross-sectional view of the end cap taken along line 16—16 of FIG. 14;

FIG. 17 is a side view of a slide block of the adjustable end cap assembly of FIG. 13;

FIG. 18 is an end view of the slide block of FIG. 17;

FIG. 19 is a cross-sectional view of the slide block taken along line 19—19 of FIG. 17;

DETAILED DESCRIPTION OF PREFERRED EMBODIMENTS

Figure 3:
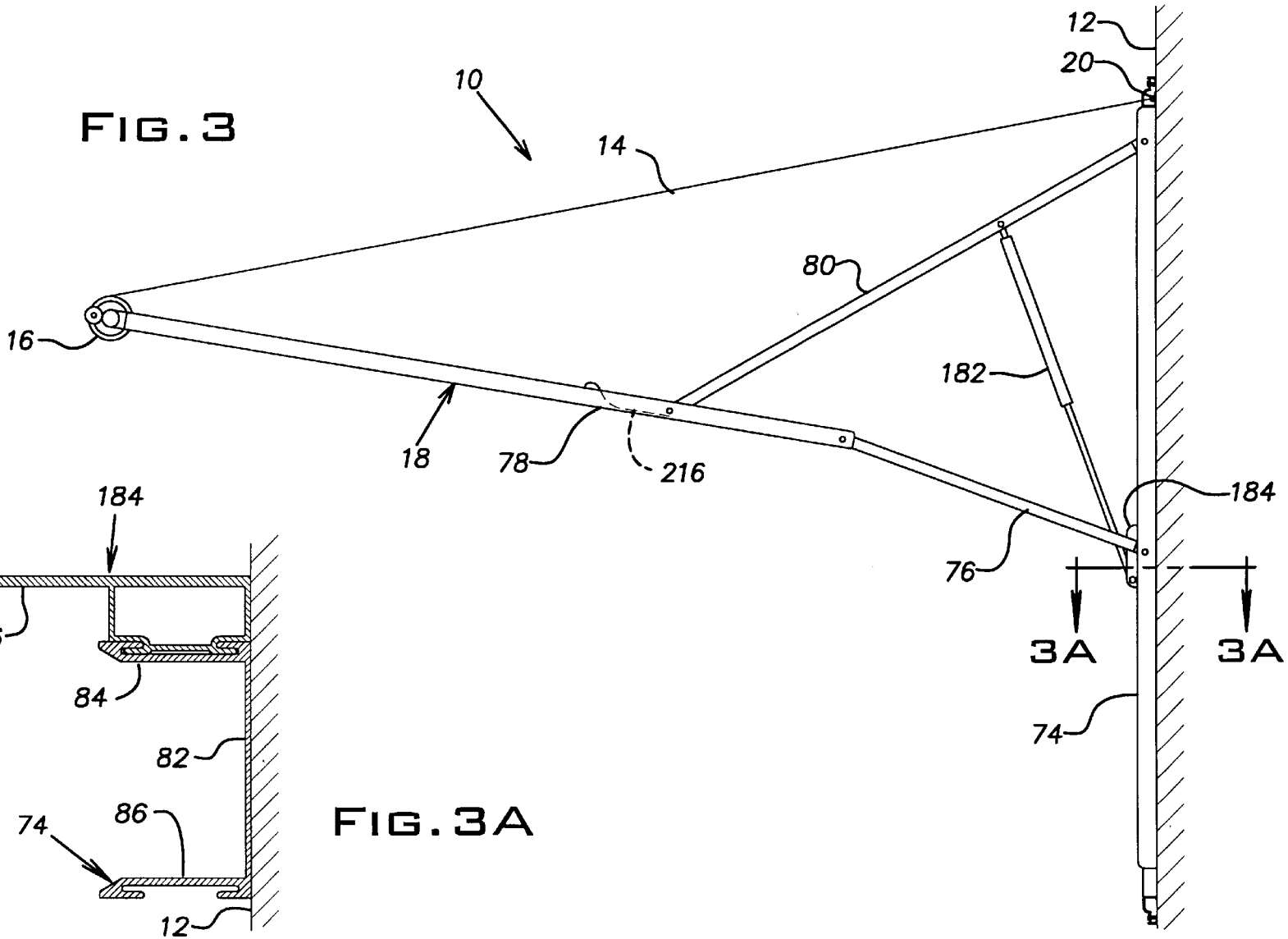
FIG. 3 is a side elevational view of the retractable awning assembly of FIGS. 1 and 2 in near fully deployed or extended position.

FIGS. 1 to 3 illustrate a powered retractable awning assembly 10 according to the present invention. The retractable awning assembly 10 is attached to a vertically-extending support wall 12 such as a side of a recreational vehicle. The term "recreational vehicle", as used in the specification and claims, includes campers, travel trailers, mobile homes, vans, buses, and the like. While the retractable awning assembly 10 is particularly advantageous when attached to recreational vehicles, it can alternatively be attached to other vertically-extending walls such as, for example, the side of a building or any other transportable or fixed structure.

The retractable awning assembly 10 is automatically operable between a retracted or stored position (best shown in FIG. 1) and an extended or sheltered position (best shown in FIG. 3). In the retracted position, the retractable awning assembly 10 is in a compact configuration close to the support wall 12 so that the recreational vehicle can travel to desired destinations with minimum side projections (best shown in FIG. 1A). After a destination is reached, the retractable awning assembly 10 is deployed from the retracted position to the extended position if a covered area is desired to protect against sun, rain, and the like.

The retractable awning assembly 10 includes an awning or canopy 14 for selectively covering an area adjacent the support wall 12, a roller assembly 16 for furling and unfurling the canopy 14, and right and left arm assemblies 18 for supporting opposite ends of the roller assembly 16.

The canopy 14 is a sheet of flexible material such as, for example, fabric, canvas, acrylic, or nylon and is preferably rectangularly shaped. The inner or top edge of the canopy 14 is secured to the support wall 12 and the outer or bottom edge of the canopy 14 is secured to the roller assembly 16. The inner and outer edges of the canopy 14 are preferably provided with an awning rope or other suitable cylindrical member. The awning rope is preferably a polypropylene rope and is preferably sewn in a hem or pocket formed at the edges of the canopy 14.

The awning rope at the inner edge of the canopy 14 is preferably held by an awning rail 20 which horizontally extends along the support wall 12 and is rigidly secured to the support wall 12 by suitable fasteners. The awning rail 20 is preferably an aluminum extrusion having a channel formed therein for retaining the awning rope in a known manner. It is noted that the inner edge of the canopy 14 can be alternately secured to the support wall 12 in other manners such as, for example, directly to the support wall 12 or to a cover attached to the wall 12. The awning rope at the outer edge of the canopy 14 is held by the roller assembly 16 as described in more detail hereinafter.

Figure 4:
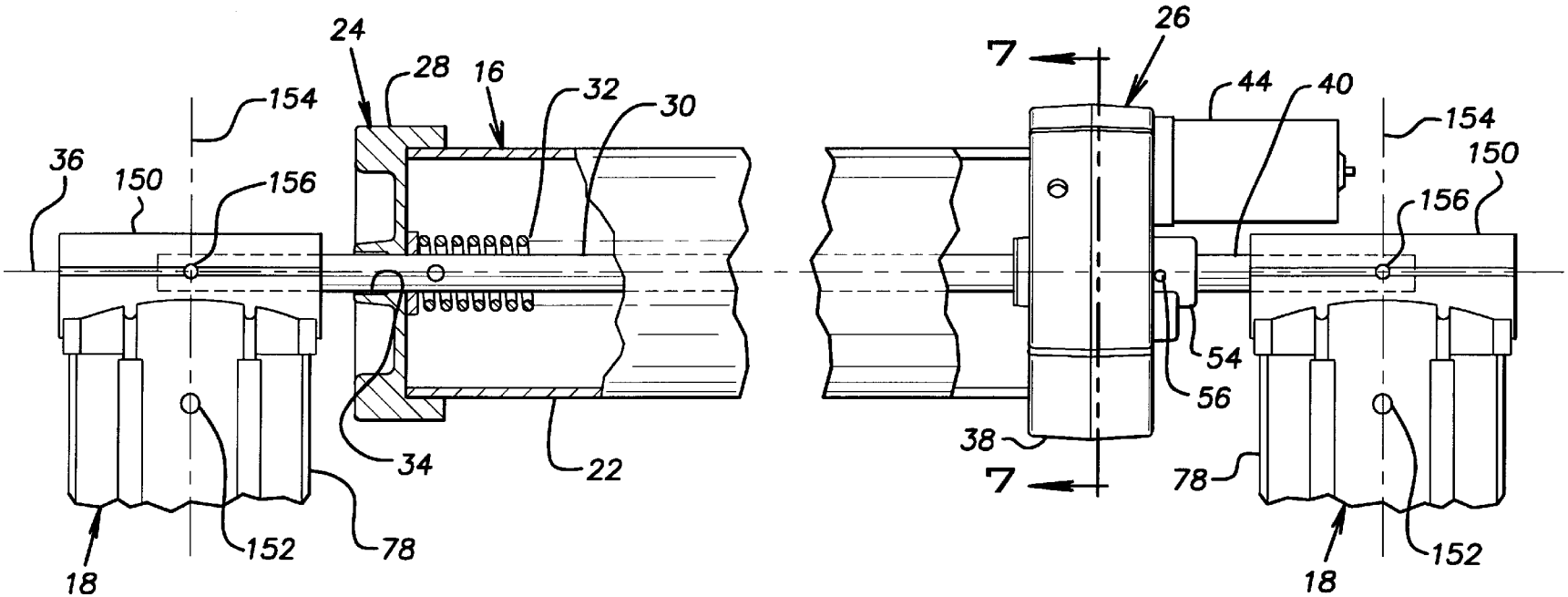
FIG. 4 is an enlarged and fragmented front elevational view, partially in cross-section, showing a roller assembly of the retractable awning assembly of FIGS. 1–3.
Figure 6:
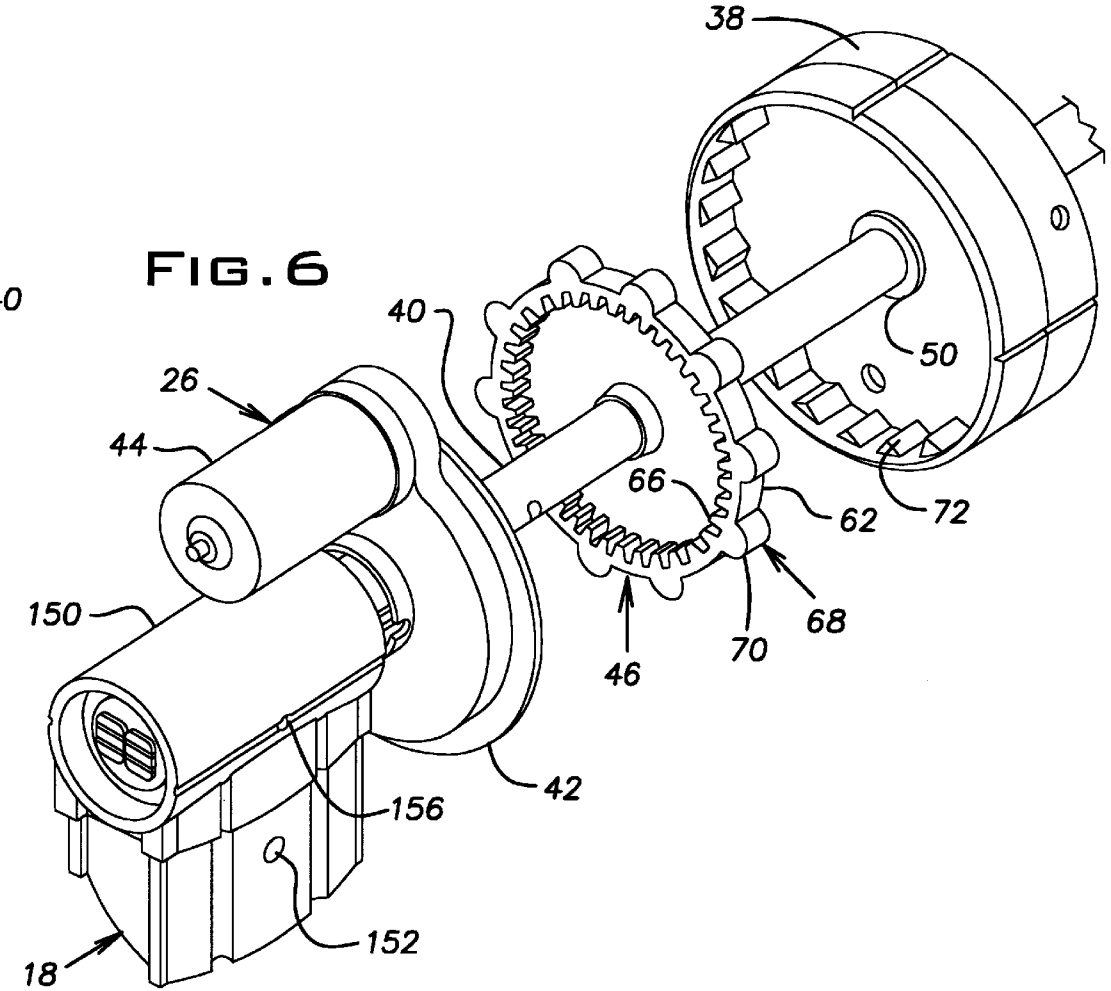
FIG. 6 is a rear perspective view similar to FIG. 5 but with the electric drive assembly partially exploded.
Figure 5:
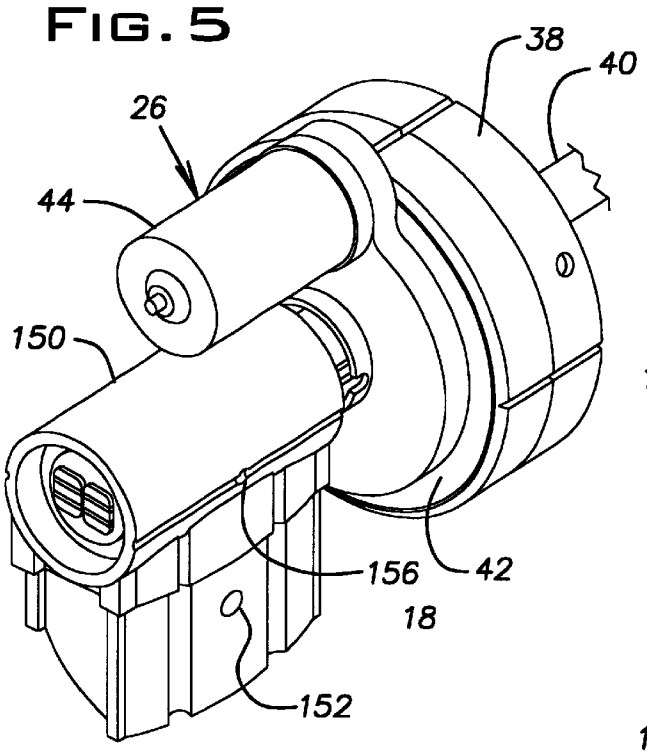
FIG. 5 is a rear perspective view of the right end of the roller assembly of FIG. 4 showing an electric drive assembly.
Figure 8:
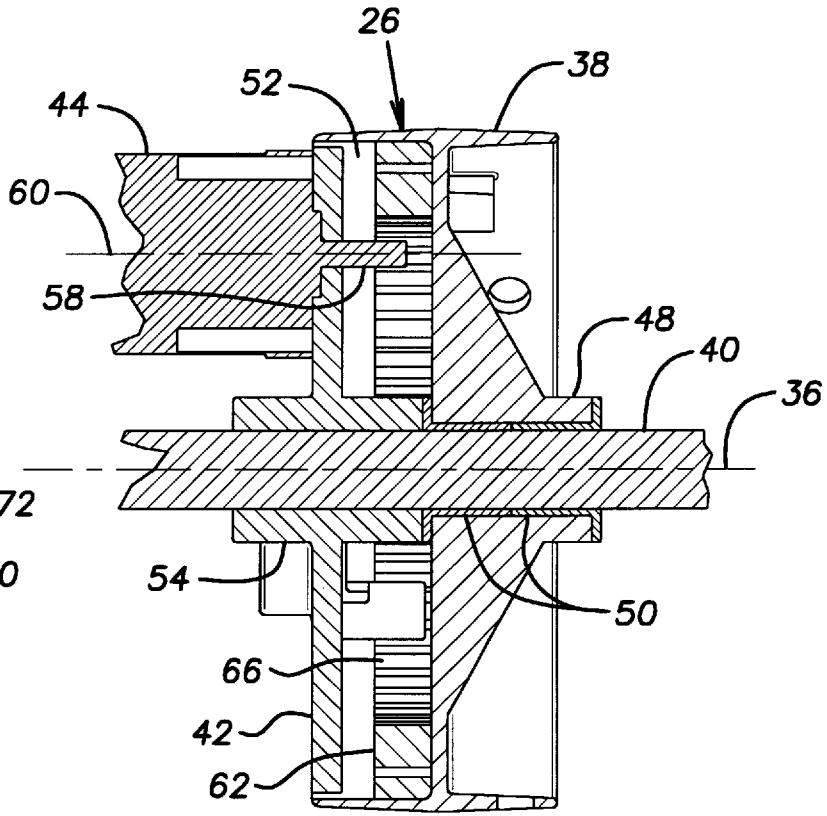
FIG. 8 is a cross-sectional view taken along line 8—8 of FIG. 7.
Figure 7:
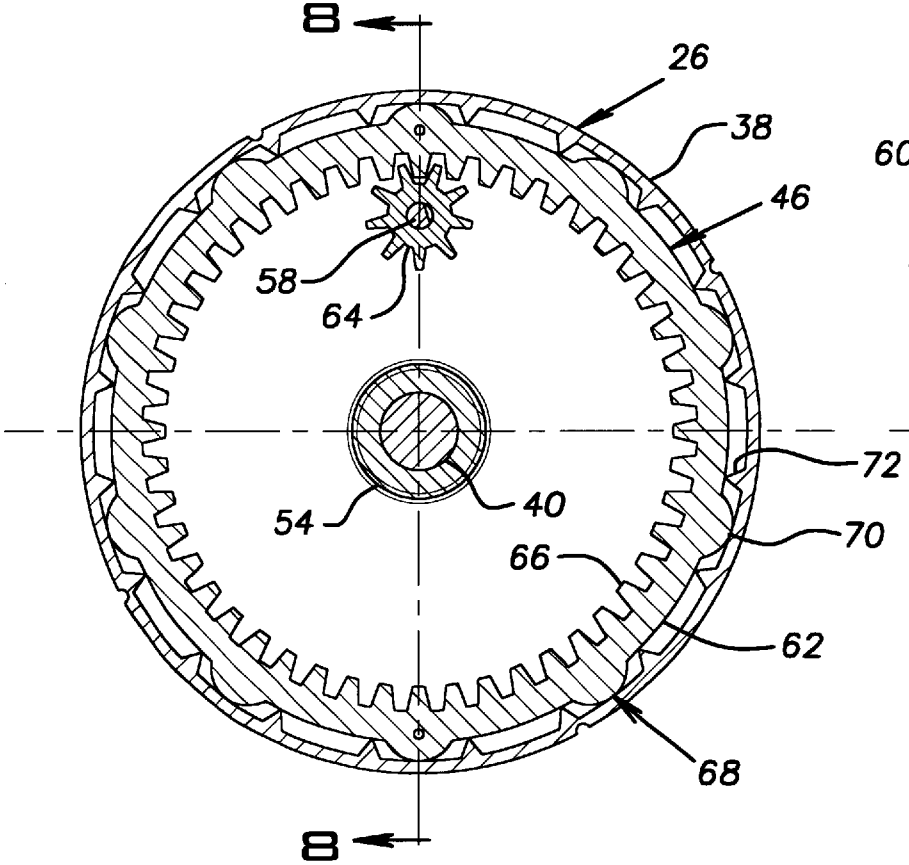
FIG. 7 is a cross-sectional view of the electric drive assembly taken along line 7—7 of FIG. 4.

As best shown in FIG. 4, the illustrated roller assembly 16 includes a roller or roller tube 22, a torsion spring assembly 24 rotatably supporting one end of the roller tube 22 (the left end of the roller tube 22 in FIG. 4), and an electric drive assembly 26 rotatably supporting the other end of the roller tube 22 (the right end of the roller tube 22 in FIG. 4). The roller tube 22 preferably has longitudinally extending channels or grooves formed therein so that the awning rope of the outer edge of the canopy 14 is secured within one of the grooves in a known manner.

The torsion spring assembly 24 includes an end cap 28, an axle or bar 30, and a torsion spring 32. The end cap 28 is rigidly secured to the roller tube 22 for rotation therewith and has a central opening 34 therein for closely receiving the bar 30. The bar 30 extends through the central opening 34 such that the roller tube 22 and the end cap 28 are free to rotate together with respect to the bar 30. The bar 30 forms a generally horizontal rotational axis 36 for the roller tube 22 and supports the end of the roller tube 22. The torsion spring 32 is disposed around the bar 30 within the roller tube 22. The torsion spring 32 is operably connected between the roller tube 22 and the bar 30 in any known manner so that rotation of the roller tube 22 with respect to the bar 30 varies tension of the torsion spring 32. The torsion spring 32, therefore, can be advantageously preloaded for biasing the roller tube 22 to roll-up the canopy 14 onto the roller tube 22. Biased in this manner, the torsion spring 32 both tensions the canopy 14 when the retractable awning assembly 10 is moved to or held in the extended position and furls the canopy 14 onto the roller tube 22 when the retractable awning assembly 10 is moved to the retracted position. It is noted that other configurations of rollers and/or tensioning mechanisms can be utilized within the scope of the present invention.

As best shown in FIGS. 4–8, the illustrated electric drive assembly 26 includes a rotor 38, an axle or bar 40, a stator 42, an electric motor 44, and a gear train 46. The rotor 38 is rigidly secured to the roller tube 22 for rotation therewith and has a central opening or hub 48 therein for closely receiving the bar 40. The bar 40 extends through the central hub 48 such that the roller tube 22 and the rotor 38 are free to rotate together with respect to the bar 40. Preferably the hub 48 is provided with suitable bearings 50 such as the illustrated flanged sleeve bearings. The bar 40 forms the generally horizontal rotational axis 36 for the roller tube 22 and supports the end of the roller tube 22.

The outer side of the rotor 38, that is the side opposite the end of roller tube 22, defines a cavity 52 having an open outer side. The bar 40 extends from the hub 48 through the cavity 52 and the open end of the cavity 52 to the arm assembly 18. The stator 42 is rigidly secured to the bar 40 and has a central opening or hub 54 therein for closely receiving the bar 40. The hub 54 is preferably secured to the bar 40 with a suitable fastener such as the illustrated pin 56 so that the stator 42 generally does not rotate with respect to the bar 40. The stator 42 is sized and shaped to generally close the open outer end of the rotor cavity 52.

The electric motor 44 is secured to the stator 42 by suitable fasteners at an opening in the stator 42 and has a rotating shaft 58 which extends into the rotor cavity 52. A rotational axis 60 of the shaft 58 is substantially parallel to and offset from the rotational axis 36 of the bar 40. Preferably, the shaft 58 is located directly above the bar 40. A suitable electric motor 44 is Part No. IM-13, E-2135 available from Globe Motors, Dayton, Ohio. The drive requirements of the electric motor 44 are relatively low due to the torsion spring 32 and the arm assemblies 18 as described in more detail hereinafter. Power for the electric motor 44 can be provided by either the recreational vehicle power system or a separate independent power system and can be 24 VDC or preferably 12 VDC. The electric motor 44 is connected to the power system by wires or cables extending along the arm assembly 18.

The gear train 46 provides gear reduction between the motor shaft 58 and the rotor 38 and includes a drive plate 62 and a pinion gear 64. The drive plate 62 has an internal gear 66 and is sized to fit within the cavity 52 of the rotor 38. The drive plate 62 is operatively connected to the rotor 38 for rotation with the rotor 38 and the roller tube 22. Preferably, a drive coupling 68 is provided between the drive plate 62 and the rotor 38 such as the illustrated interconnecting lobes. The drive plate 62 and the rotor 38 are each provided with a plurality of lobes 70, 72 about their peripheries which cooperate to limit rotational movement between the drive plate 62 and the rotor 38 and to allow axial movement between the drive plate 62 and the rotor 38. The pinion gear 64 is operably connected to the free end of the motor shaft 58 for rotation therewith and meshes with the internal gear 66 of the drive plate 62. The internal gear 66 and the pinion gear 64 are sized to obtain a desired rotational speed of the rotor 38 and the roller tube 22 in response to the operational speed of the motor shaft 58. Suitable gears 64, 66 are believed to be a 16DP-9 tooth pinion gear and a 16DP-48 tooth-14.5 PA internal gear. It is noted that the electric motor 44 can alternatively be drivingly connected to the roller tube 22 with other types of gears drives such as, for example, a worm or planetary gear drive or other types of drive connections such as, for example chain or screw drives.

A control system for the awning assembly 10 includes means for stopping the electric motor 44 when the awning assembly 10 reaches the retracted position and means for stopping the electric motor 44 when the awning assembly 10 reaches the extended position. The stopping means preferably includes a current limit on the electric motor 44. If the electric motor 44 normally operates at about 1.5 amps, for example, the current limit can be about 3.5 amps wherein the electric motor 44 shuts off when its current reaches about 3.5 amps. When moving to the retracted position, the current will naturally reach the current limit in a reasonable manner as the canopy 14 is completely rolled on the roller tube 22. When moving to the extended position, however, a suitable extended member may be required that engages a stop when the awning assembly 10 reaches the extended position to cause the electric motor 44 to trigger the current limit. It is noted that other stopping means for the electric motor 44 can be used such as, for example, stopping at position limit switches such as micro-switches or rotating for a predetermined number of revolutions such as solid state counting of motor brush pulses.

It is noted that the roller assembly 16 can also include a lock and release mechanism for selectively preventing rotation of the roller tube 22 in one direction or the other. The lock mechanism can be of any suitable type. See, for example, U.S. Pat. No. 5,732,756, disclosing a suitable lock mechanism for the roller assembly 16. It should be noted, however, that the lock mechanism is optional and is generally not required because the arm assemblies 18 hold the roller assembly 16 in position as described in more detail hereinafter.

As best shown in FIG. 4, the bars of the roller assembly 16 are supported by the arm assemblies 18. Each arm assembly 18 is disposed in a generally vertical plane at an associated side edge of the canopy 14 and an associated end of the roller assembly 16. The left and right arm assemblies 18 have essentially identical structures and therefore only one will be described in detail hereinafter.

Figure 9:
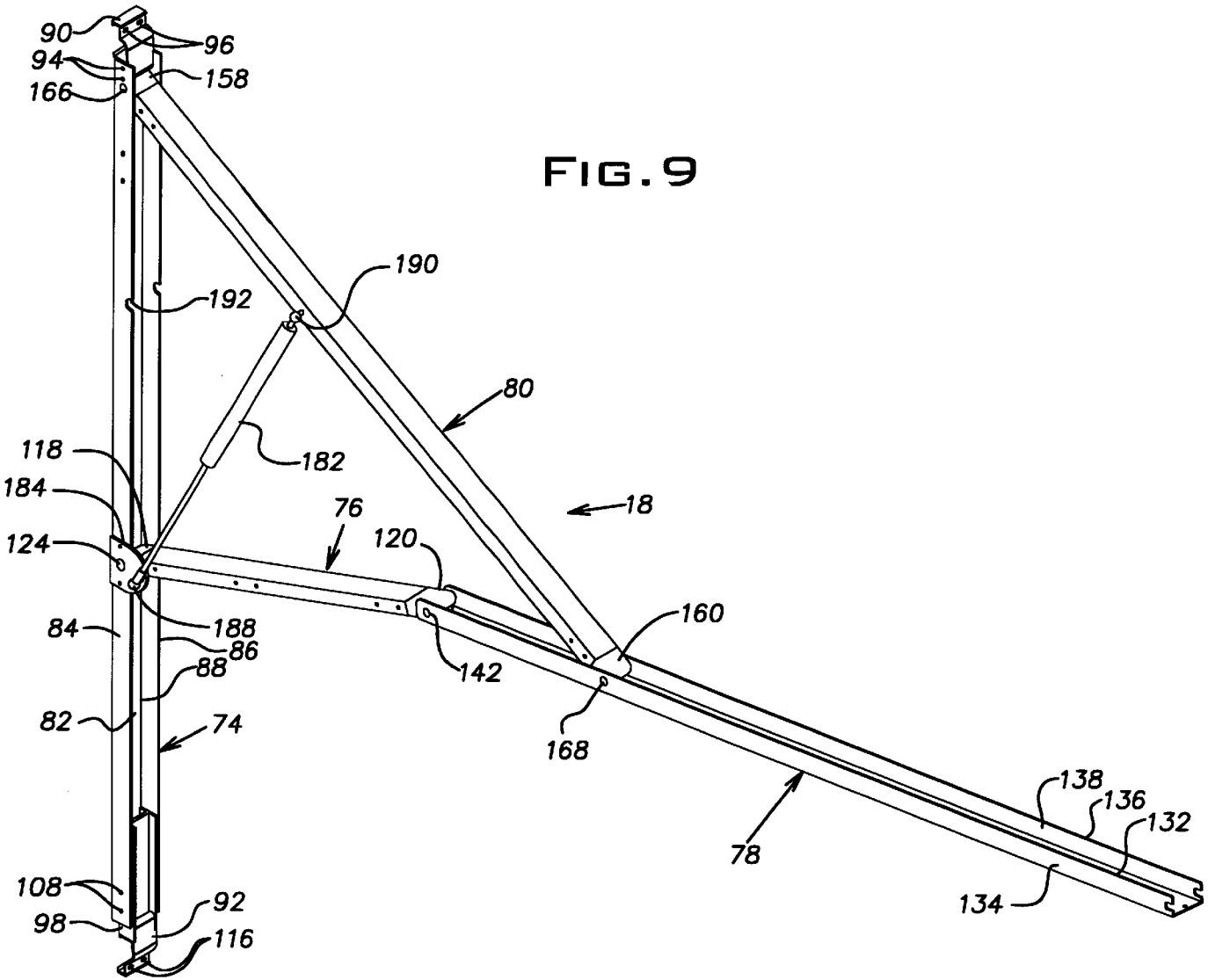
FIG. 9 is an enlarged perspective view of an arm assembly of the retractable awning assembly of FIGS. 1–3 near the fully extended position.
Figure 10:
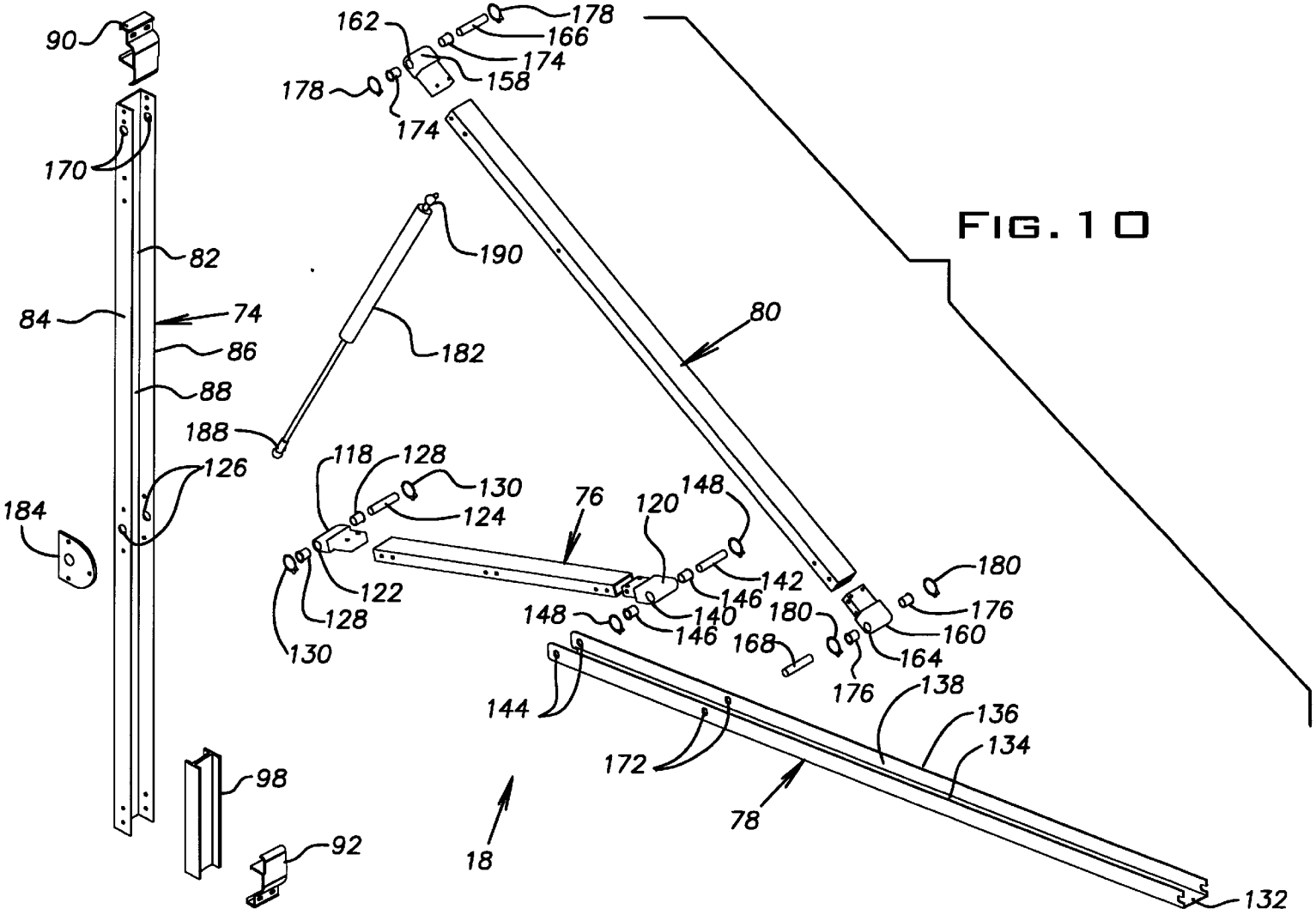
FIG. 10 is an exploded view of the arm assembly of FIG. 9.

As best shown in FIGS. 9 and 10, each arm assembly 18 is a four bar linkage including a first or base arm 74, a second or bottom arm 76, a third or extended arm 78, and a fourth or top arm 80. Each of the arms 74, 76, 78, 80 are substantially straight and elongate and are fixed in length. The arms 74, 76, 78, 80 are preferably extrusions of a light weight, high strength material such as an aluminum alloy.

The base arm 74 has a main wall 82 and inner and outer side walls 84, 86 which perpendicularly extend from opposed side edges of the main wall 82 to form a vertically extending and outward facing channel 88 (best shown in FIG. 1). The channel 88 is outward facing so that it at least partially receives the top and bottom arms 80, 76 when in the retracted position (best shown in FIGS. 1 and 1A).

The base arm 74 is rigidly secured to the support wall, preferably with top and bottom mounting brackets 90, 92. The mounting brackets 90, 92 are preferably extrusions of a light weight, high strength material such as an aluminum alloy. As best shown in FIG. 11, the top mounting bracket 90 extends from the open upper end of the base arm 74. At the upper end of the base arm 74, the side walls 84, 86 are provided with openings for cooperating threaded fasteners 94 to rigidly attach the top mounting bracket 90 to the base arm 74. The top mounting bracket 90 is preferably formed for receiving the threaded fasteners 94. The top mounting bracket 90 has an inwardly extending top flange or hook member at an upper end thereof which can be advantageously located at a top rail of a recreational vehicle when the retractable awning assembly 10 mounted thereto. The top mounting bracket 90 is also provided with openings below the top flange for cooperating with threaded fasteners 96 to rigidly secure the top mounting bracket 90 to the support wall 12.

As best shown in FIGS. 12 and 12A, the lower end of the base arm 74 is preferably provided with a base arm extension 98. The base arm extension 98 is substantially straight and elongate and is fixed in length. The base arm extension 98 cooperates with the base arm 74 so that: the distance between the top and bottom mounting brackets 90, 92, which is the effective length of the base arm 74, is variable. The base arm extension 98 is preferably an extrusion of a light weight, high strength material such as an aluminum alloy.

The base arm extension 98 preferably has a generally H-shaped cross-section formed by a main wall 100 and inner and outer side walls 102, 104 which perpendicularly extend from ends the main wall 100. The base arm extension 98 is sized to fit within the channel 88 of the base arm 74 so that it can longitudinally move or slide therein in a telescoping manner. Outwardly directed protrusions 106 are provided at the base of the side walls 102, 104 which longitudinally extend along the length of the base arm extension 98. The protrusions 106 are sized and shaped to cooperate with undercuts or grooves formed in the side walls 84, 86 of the base arm 74 to interlock the base arm 74 and the base arm extension 98 together. Secured in this manner, the base arm 74 and the base arm extension 98 are interlocked together in a drawer-like manner such that they can only move longitudinally relative to one another.

At the lower end of the base arm 74, the side walls 84, 86 are provided with openings for cooperating threaded fasteners 108 to rigidly attach the base arm extension 98 to the base arm 74. The side walls 102, 104 of the base arm extension 98 are preferably provided with inwardly directed flanges 110 which longitudinally extend along the length of the base arm extension 98. The flanges 110 are inwardly spaced apart from the main wall to receive and secure the threaded fasteners 108 therebetween. The side walls 102, 104 of the base arm extension 98 can be provided with a plurality of longitudinally spaced-apart openings so that the position of base arm extension 98 relative to the base arm 74 can be easily adjusted to a plurality of positions.

The bottom mounting bracket 92 extends from the lower end of the base arm extension 98. At the lower end of the base arm extension 98, the main wall 100 is provided with openings for cooperating threaded fasteners 112 to rigidly attach the bottom mounting bracket 92 to the base arm extension 98. The bottom mounting bracket 92 is preferably formed for receiving the threaded fasteners 112. The bottom mounting bracket 92 also has an upwardly directed protrusion 114 sized and shaped to cooperate with the main wall 100 and flanges 110 of the base arm extension 98. The protrusion 114 extends between the main wall 100 and the flanges 110 to interlock the bottom mounting bracket 92 and the base arm extension 98. The bottom mounting bracket 92 has an inwardly extending bottom flange or hook member at an lower end thereof which can be advantageously located at the box iron of a recreational vehicle when the retractable awning assembly 10 is mounted thereto. The bottom mounting bracket 92 is also provided with openings for cooperating with threaded fasteners 116 to rigidly secure the bottom mounting bracket 92 to the support wall 12.

As best shown in FIGS. 9 and 10, the bottom arm 76 has an inner end pivotally mounted to a central or intermediate portion of the base arm 74. The bottom arm 76 is preferably tubular in cross-section (best shown in FIG. 1A) and is provided with inner and outer end plugs or caps 118, 120 secured to and closing the open inner and outer ends of the bottom arm 76 respectively. The end caps 118, 120 are secured to the bottom arm in any suitable manner such as, for example, rivets or screws. The inner end cap 118 is provided with an opening 122 for receiving a pivot shaft 124 therethrough. The pivot shaft 124 extends through the inner end cap opening 122 and openings 126 in the side walls 84, 86 of the base arm 74 to form a pivot joint or rotatable connection between the base arm 74 and the bottom arm 76. The pivot shaft 124 is preferably provided with suitable bearings 128, such as the illustrated flanged sleeve bearings, and is preferably held in position by retaining rings 130. The inner end cap 118 is optionally biased to a central position within the channel 88 of the base arm 74 by spring washers located between the side walls 84, 86 of the base arm 74 and flanges of the bearings 128.

The extended arm 78 has an inner or lower end pivotally mounted to an outer or lower end of the bottom arm 76 and an outer or upper end connectable to the end of the roller assembly 16. The extended arm 78 is preferably channel-shaped in cross-section having a main wall 132 and inner and outer side walls 134, 136 perpendicularly extending from opposed side edges of the main wall 132 to form a channel 138 (best shown in FIG. 1A). The channel 138 preferably faces upward when the retractable awning assembly 10 is extended so that it at least partially receives the bottom arm 76 therein when in the retracted or stored position (as best shown in FIGS. 1 and 1A).

The outer end cap 120 of the bottom arm 76 is provided with an opening 140 for receiving a pivot shaft 142 therethrough. The pivot shaft extends through the outer end cap opening 140 and openings 144 in the side walls 134, 136 of the extended arm 78 to form a pivot joint or rotatable connection between the bottom arm 76 and the extended arm 78. The pivot shaft 142 is preferably provided with suitable bearings 146, such as the illustrated flanged sleeve bearings, and is preferably held in position by suitable retaining rings 148. The outer end cap 120 is optionally biased to a central position within the channel 138 of the extended arm 78 by spring washers located between the side walls 134, 136 of the extended arm 78 and flanges of the bearings 146.

As best shown in FIG. 4, the upper or outer end of the extended arm 78 supports the roller assembly 16. The free end of the extended arm 78 is provided with an upper end cap 150 which is closely received and rigidly secured thereto. The upper end cap 150 is preferably secured to the extended arm 78 by rivets 152, but can be alternatively secured in other manners.

The upper end cap 150 and the bars 30, 40 of the roller assembly 16 are preferably secured together in a manner which allows rotation of the bars 30, 40 relative to the upper end caps 150, about only one axis which facilitates handling and misalignment. The bars 30, 40 cannot rotate about the rotational axis 36 or the longitudinal axes 154 of the extended arms 78. The bars 30, 40 can, however, rotate about a pivot axis which is substantially perpendicular to both the rotational axis 36 and the longitudinal axes 154 of the extended arms 78 at the outer or upper end of the extended arms 78. In the illustrated embodiment, each pivot axis is formed by a pin 156 which extends through the associated bar 30, 40 and the associated upper end cap 150. The bar 30, 40 and the upper end cap 150, however, can be alternately joined in other suitable manners such as, for example, by a screw or tube rivet.

As best shown in FIGS. 9 and 10, the top arm 80 has an inner or upper end pivotally mounted to an upper portion of the base arm 74 and an outer or lower end pivotally mounted to an intermediate portion of the extended arm 78 generally near the lower or inner end of the extended arm 78. The top arm 80 is preferably tubular in cross-section (best shown in FIG. 1A) and preferably has inner and outer end plugs or caps 158, 160 secured to and closing the open inner and outer ends of the top arm 80 respectively. The inner and outer end caps 158, 160 are each provided with an opening 162, 164 for receiving a pivot shaft 166, 168 therethrough. One pivot shaft 166 extends through the inner end cap opening 162 and openings 170 in the side walls 84, 86 of the base arm 74 to form a pivot joint or rotatable connection between the base arm 74 and the top arm 80. The other pivot shaft 168 extends through the outer end cap opening 164 and openings 172 in the side walls 134, 136 of the extended arm 78 to form a pivot joint or rotatable connection between the extended arm 78 and the top arm 80. The pivot shafts 166, 168 are each preferably provided with suitable bearings 174, 176, such as the illustrated flanged sleeve bearings, and are preferably held in position by suitable retaining rings 178, 180. The inner end cap 158 is optionally biased to a central position within the channel 88 of the base arm 74 by spring washers located between the side walls 84, 86 of the base arm 74 and flanges of the bearings 174. The outer end cap 160 is also optionally biased to a central position within the channel 138 of the extended arm 78 by spring washers located between the side walls 134, 136 of the extended arm 78 and flanges of the bearings 176.

It is this assembly 18 of pivotally attached bars or arms 74, 76, 78, 80 which form a four-bar linkage that provides a support base which reaches out or extends to support the roller assembly 16 and fold backs or retracts into a compact stack against the support wall 12, by stacking the tubular-shaped bottom and top arms 76, 80 within the channel-shaped base and extended arms 74, 78.

Each arm assembly 18 also includes a spring 182 for outwardly biasing the arm assembly 18 toward the extended position. In the illustrated embodiment, the spring 182 is a compression gas spring. A suitable compression gas spring is available from Suspa, Inc., Grand Rapids, Mich. It is noted that other types of springs can be utilized such as, for example, tension springs and/or coil springs. For examples of suitable alternative spring configurations, see U.S. patent application Ser. No. 09/137,201 filed on Aug. 20, 1998, which is expressly incorporated herein in its entirety by reference.

Figure 3A:
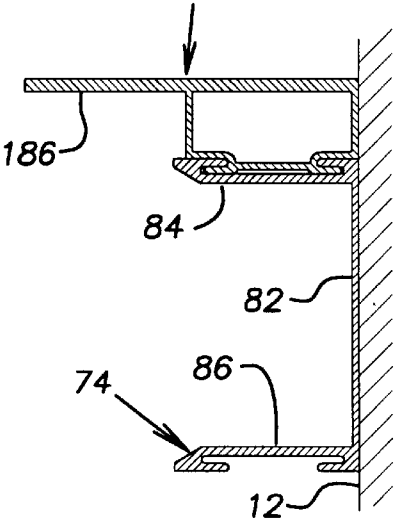
FIG. 3A is an enlarged cross-sectional view taken along line 3A—3A of FIG. 3.

The spring 182 is mounted between the base arm 74 and the top arm 80. A first or lower end of the spring 182 is mounted to the base arm 74 by a mounting bracket 184. The mounting bracket 184 is secured to the inner side wall 84 of the base arm 74 at an intermediate portion thereof by any suitable manner such as, for example, rivets or screws. As best shown in FIG. 3A, the mounting bracket 184 is preferably an extrusion of a light weight, high strength material such as, for example, an aluminum alloy. The mounting bracket is preferably shaped to interlock with the base arm 74 and to have an outwardly directed flange 186. As shown in FIGS. 9 and 10, the mounting bracket 184 is preferably secured at the pivot joint between the base arm 74 and the bottom arm 76.

The spring 182 is provided with pivotable lower and upper ball end joints 188, 190. The lower end joint 188 is connected to the flange 186 of the mounting bracket 184 in a suitable manner such as, for example, a threaded stud of the end joint 188. The upper end joint 190 is mounted to the top arm 80 at a central or intermediate portion thereof by any suitable manner such as, for example, a threaded stud of the end joint 190. The inner side wall 84 of the base arm 74 is provided with a suitable cut out or clearance opening 192 for the upper end joint 190 when the retractable awning assembly 10 is in the retracted position.

In the illustrated retractable awning assembly 10, the spring 182 is mounted with the cylinder portion secured to the top arm 80 and the rod portion secured to the base arm 74. It is noted, however, that the spring 182 can alternatively be mounted in the reverse orientation, that is, with the rod portion secured to the top arm 80 and the cylinder portion secured to the base arm 74. This reverse orientation may be particularly advantageous when the retractable awning assembly 10 is secured to a recreational vehicle or other vehicle to protect against road splash.

The spring 182 of the arm assembly 18 is positioned and sized to counterbalance the torsion spring 32 of the roller assembly 16. Note that there is an increase in leverage of the roller assembly torsion spring 32 and a decrease in leverage of the arm assembly spring 182 as the retractable awning assembly 10 moves toward the retracted position (best shown in FIG. 1). As the retractable awning assembly 10 is retracted, stored energy in the roller assembly torsion spring 32 assists retraction and is transferred to the arm assembly spring 182. When in the retracted position, the relatively high leverage of the roller assembly torsion spring 32 holds the roller tube 22 tight against the support wall 12. Also, note that there is a decrease in leverage of the roller assembly torsion spring 32 and an increase in leverage of the arm assembly spring 182 as the extended arm 78 moves toward the extended position (best shown in FIG. 1). As the retractable awning assembly 10 is extended, stored energy in the arm assembly spring 182 assists deployment and is transferred to the roller assembly torsion spring 32. When in the extended position, the relatively high leverage of the arm assembly spring 182 holds the awning assembly 10 in the extended position. Requirements of the electric motor 44 to extend and retract the awning assembly 10 are relatively low because the springs 32, 182 "counter balance" each other, that is, they "load level" or transfer energy back and forth, in the above described manner. Therefore, a relatively small electric motor 44 can be used which is important in that it minimizes cost, wire size, battery draw, and visual problems (proportion with other components of the awning assembly 10).

While the relatively high leverage of the roller assembly torsion spring 32 pulls the roller tube 22 tight against the support wall 12 as the awning assembly 10 moves to the retracted position, the bottom of the arm assembly 18 may not close-up tight against the base arm 74, that is, the bottom of the arm assembly 18 may not "kick in". Therefore, the bottom arm 76 is preferably a "short link" in the arm assembly 18 which creates tension in the linkage at the support wall 12 to generate a kick-in force. In order to have reasonable variations in arm tension, however, the components require relatively tight manufacturing tolerances. To obtain a reasonable variation in arm tension with components having normal manufacturing tolerances, at least one end cap 118, 120 of the bottom arm 76 is preferably spring loaded. Either the inner end cap 118 or the outer end cap 120 can be spring loaded or both the inner and outer end caps 118, 120 can be spring loaded.

FIGS. 13–19 illustrate a suitable end cap assembly which is spring loaded and includes the end cap 118, 120, a slide block 196, and a compression spring 198. The end cap 118, 120 forms the laterally extending opening 122, 140 sized for closely receiving the pivot shaft 124, 142 and a cavity 200 located rearward of the opening 122, 140. The cavity 200 is formed by spaced apart outer and inner walls 202, 204 and spaced-apart upper and lower walls 206, 208 connecting the outer and inner walls 202, 204. In the illustrated embodiment of the end cap assembly 194, the lateral sides of the cavity 200 are open. The rearward portion of the end cap 118, 120 forming the cavity 200 is sized and shaped so that it can be inserted into the end of the tubular-shaped bottom arm 76. The end cap 118, 120 preferably forms a rearward facing abutment 210 to limit insertion of the end cap 118, 120 into the bottom arm 76. The end cap 118, 120 is preferably an extrusion of a suitable light weight material such as an aluminum alloy.

The slide block 196 is sized and shaped to fit within the end block cavity 200 closely between the upper end lower walls 206, 208 and to axially slide between the outer and inner walls 202, 204. The slide block 196 forms a laterally extending opening 212 sized to receive a suitable fastener to attach the bottom arm 76 to the slide block 196. The slide block 196 also forms an axially extending and rearward facing blind hole 214 sized for receiving a portion of the compression spring 198 therein. The slide block 196 is preferably an extrusion of a suitable light weight material such as an aluminum alloy. The compression spring 198 is preferably a coil spring.

The slide block 196 is positioned within the cavity 200 of the end cap 118, 120 with the compression spring 198 extending between the slide block 196 and the end cap inner wall 204. The compression spring 198 forwardly biases the slide block 196 against the outer wall 202 but the slide block 196 is axially movable toward the inner wall 204 against the bias of the compression spring 198. When the end cap 118, 120 is inserted into the end of the bottom arm 76 and the slide block 196 is secured to the bottom arm 76 with a suitable fastener, the end cap 118, 120 is axially movable relative to the bottom arm 76 against the bias of the compression spring 198 to control the tension of the bottom arm 76.

As the awning assembly 10 moves from the retracted position, the arm assembly spring 182 and dead weight of the assembly have relatively low leverage and may not provide an effective force, depending on the mounting location of the arm assembly spring 182, to outwardly pivot the arms 76, 78, 80 and stretch out the canopy 14 for the first 6 to 12 inches of deployment, that is, the arm assembly 18 may not provide an adequate "push-off" force. Therefore, a change in the mounting location of the arm assembly spring 182 and/or a separate push-off spring 216 is required. Note that the poor leverage of the arm assembly spring 182 when the awning assembly 10 is near the support wall 12 is largely due to the fact that the mounting bracket 184 of the arm assembly spring 182 must be kept short so that the retractable awning assembly 10 is kept to a low profile in the retracted position. Thus the push-off spring 216 is preferable in many applications.

Figure 20:
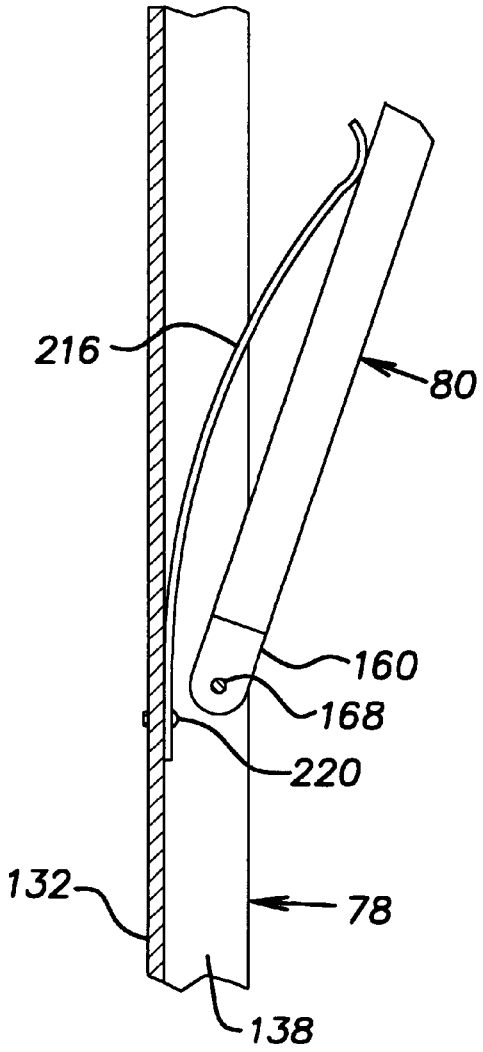
FIG. 20 is an enlarged and fragmented side elevational view, partially in cross section, showing a push-off spring of the retractable awning assembly of FIGS. 1–3.
Figure 21:
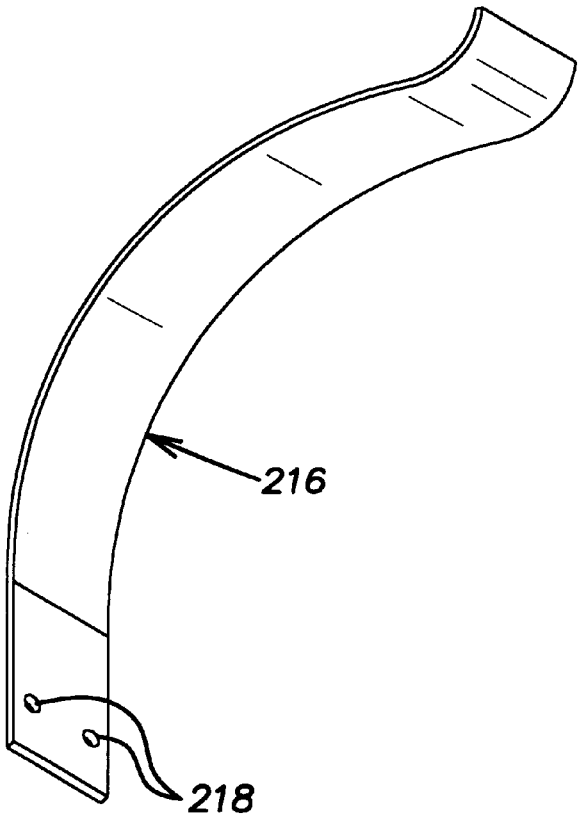
FIG. 21 is an enlarged perspective view of the push-off spring of FIG. 20.

As best shown in FIGS. 20 and 21, the push-off spring 216 is preferably a compression, bowed leaf spring acting between the extended arm 78 and the top arm 80 near the pivot joint between the extended arm 78 and the top arm. It is noted, however, that the push-off spring 216 can be another type of spring such as a coil spring and/or can be located at other locations such as near the pivot joint between the base arm 74 and the top arm. The leaf spring near the pivot joint between the extended arm 78 and the top arm 80 has poor mechanical advantage but is simple, unobtrusive, and supplies the few pounds of force which are necessary.

The illustrated push-off spring 216 has a fixed lower end secured to the extended arm 78 and a free upper end engaging the top arm 80. The lower end is provided with suitable openings 218 and is fastened to the extended arm 78 with suitable fasteners 220 such as, for example, rivets or bolts. Mounted in this manner, the push-off spring 216 applies a force which outwardly pivots the extended arm 78 relative to the top arm 80. The push-off spring 216 is compressed when the top arm 80 is pivoted into the channel 138 of the extended arm 78. In the retracted or flattened position, therefore, the push-off spring 216 stores energy which is at least partially released upon the initial extension of the retractable awning assembly 10.

As best shown in FIGS. 1 and 1A, the top and bottom arms 80, 76 are stacked within the base and extended arias 74, 78 so that the retractable awning assembly 10 is in close relationship with the support wall 12 and the canopy 14 is fully rolled-up on the roller assembly 16 when the retractable awning assembly 10 is the retracted position. The base arm 74 and the extended arm 78 each have a substantially parallel relationship with the support wall 12. The bottom arm 76 and the top arm 80 are each located partially within the base arm 74 and partially within the extended arm 78. The push-off spring 216 is compressed between the extended arm 78 and the top arm 80. A suitable travel lock is preferably provided to secure the arms in their retracted positions. The travel lock can be manually locked and unlocked, but is preferably automatically locked, and is more preferably automatically locked and unlocked.

With reference to FIGS. 1–3, to open the retractable, awning assembly 10, the operator manually unlocks the travel lock, if a manual travel lock is provided. The operator then activates the control system so that power is provided thereto. The control system unlocks the automatic travel lock, if an automatic travel lock is provided, and activates the electric motor 44. The electric motor 44 begins to rotate the roller tube 22 and unwind the canopy 14.

As the canopy 14 unwinds from the roller tube 22, the push-off spring 216 outwardly pivots the extended arm 78 to move the roller assembly 16 and tension the canopy 14 as the canopy 14 unwinds. Outward rotation of the extended arm 78 results in upward rotation of the top arm 80 about its pivot joint with the base arm 74 and upward rotation of the bottom arm 76 about its pivot joint with the base arm 74. As the top arm 80 is upwardly rotated about its pivot joint with the base arm 74, the leverage of the arm assembly spring 182 increases and assists deployment by supplying a force to counterbalance the roller assembly torsion spring 32 and extend the arm assembly 18 as the canopy 14 is unwound.

As best shown in FIG. 3, the electric motor 44 continues to rotate the roller the 22 and unwind the canopy 14 until the retractable awning assembly 10 is in the fully deployed position. Once in the fully deployed position, the control system deactivates the electric motor 44 to stop rotation of the roller tube 22. In the fully deployed position, the canopy 14 is unfurled from the roller tube 22 and the arm assemblies 18 are fully extended with the extended arm 78 generally coaxial with the bottom arm 76. The arm assembly spring 182 pushes upwardly on the top arm 80 to hold the roller assembly 16 in the deployed position and the roller assembly torsion spring 32 pulls the canopy 14 tight between the awning rail 20 and the roller tube 22. A suitable additional lock may also be provided to secure the arms 76, 78, 80 in their deployed positions if desired.

To close the retractable awning assembly 10, the operator activates the control system which initiates the electric motor 44 to rotate the roller tube 22 in the opposite direction to permit the canopy 14 to roll onto the roller assembly 16. The bias provided by the roller assembly torsion spring 32 rolls the canopy 14 onto the roller assembly 16 and pulls the roller assembly 16 toward the support wall 12. As the roller assembly 16 moves toward the support wall 12, the top arm 80 is downwardly rotated about its pivot joint with the base arm 74 and the length of the arm assembly spring 182 is decreased to store energy therein for later deployment.

As best shown in FIG. 2, downward rotation of the top arm 80 and downward rotation of the bottom arm 76, upwardly rotates the extended arm 78 about its pivot joint with the bottom arm 76. As the top end of the extended arm 78 moves toward the support wall 12, the canopy 14 is rolled back onto the roller assembly 16.

As best shown in FIG. 1, the roller assembly torsion spring 32 pulls the top of the extended arm 78 tight against the base arm 74 and the tension of the bottom arm 76 kicks-in the bottom of the extended arm 78 against the base arm 74 so that the extended arm 78 is generally parallel with the base arm 74 and the support wall 12. In this position, the canopy 14 is fully furled up onto the roller tube 22 and the retractable awning assembly 10 is in the retracted position. The travel lock automatically locks or the operator manually locks the travel lock to prevent outward movement of the arms 76, 78, 80.

Although particular embodiments of the invention have been described in detail, it will be understood that the invention is not limited correspondingly in scope, but includes all changes and modifications coming within the spirit and terms of the claims appended hereto.

What is claimed is:

1. A retractable awning assembly for mounting to a wall, said awning comprising:

a roller;

a flexible canopy rollable onto said roller and having an inner edge for connection to the wall and an outer edge secured to said roller;

a first spring biasing said roller to roll said canopy onto said roller and said first spring tensions said canopy;

a pair of arm assemblies supporting opposite ends of said roller and operable to move said roller between a retracted position adjacent the wall and an extended position spaced from the wall;

at least one second spring biasing said arm assemblies toward the extended position, wherein said second spring is a push-off spring adapted to outwardly bias said extended arm only when said arm assembly is near said retracted position; and an electric motor operable to rotate said roller in either direction.

2. The retractable awning assembly according to claim 1, wherein said first spring is a torsion spring.

3. The retractable awning assembly according to claim 2, wherein said first spring is operably connected to one end of the roller and said electric motor is operably connected to the other end of said roller.

4. The retractable awning assembly according to claim 1, wherein said motor is operably connected to said roller with a gear train.

5. The retractable awning assembly according to claim 4, wherein said gear train includes an internal gear attached to said roller and a pinion gear attached to said motor and cooperable with said internal gear.

6. The retractable awning assembly according to claim 1, wherein each of said arm assemblies include a vertically extending base arm for connection to the wall, a bottom arm having a first end pivotally connected to said base arm, an extended arm having a first end pivotally connected to said bottom arm and a second end connected to and supporting said roller, a top arm having a first end pivotally connected to said base arm above said bottom arm and a second end pivotally connected to said extended arm, said second spring extending between said base arm and one of said bottom arm and said top arm for outwardly pivoting said bottom arm, said extended arm, and said top arm toward the extended position.

7. The retractable awning assembly according to claim 6, wherein said second spring extends between said base arm and one of said bottom arm and said top arm for outwardly pivoting said bottom arm, said extended arm, and said top arm toward the extended position.

8. The retractable awning assembly according to claim 7, wherein said second spring is a compression spring extending between said base arm and said top arm.

9. The retractable awning assembly according to claim 7, wherein said second spring is a gas spring.

10. The retractable awning assembly according to claim 6, each of said arm assemblies further include a push-off spring adapted to outwardly bias said extended arm only when said arm assembly is near said retracted position.

11. The retractable awning assembly according to claim 10, wherein said push-off spring is a leaf spring.

12. The retractable awning assembly according to claim 10, wherein said push-off spring acts between said extended arm and said top arm.

13. The retractable awning assembly according to claim 6, wherein said bottom arm is tensioned to bias a lower end of the arm assembly to said retracted position when said arm assembly is near said retracted position.

14. The retractable awning assembly according to claim 13, wherein said bottom arm is spring biased.

15. The retractable awning assembly according to claim 1, wherein said second spring is a gas spring.

16. The retractable awning assembly according to claim 1, wherein there are a pair of said second springs and each of said second springs is associated with a different one of the arm assemblies.

17. A retractable awning assembly for mounting to a wall, said awning comprising:

a roller;

a flexible canopy rollable on said roller and having an inner edge for connection to the wall and an outer edge secured to said roller;

a pair of arm assemblies supporting opposite ends of said roller and operable to move said roller between a retracted position adjacent the wall and an extended position spaced from the wall, each of said arm assemblies including a vertically extending base arm for connection to the wall, a bottom arm having a first end pivotally connected to said base arm, an extended arm having a first end pivotally connected to said bottom arm and a second end connected to and supporting said roller, a top arm having a first end pivotally connected to said base arm above said bottom arm and a second end pivotally connected to said extended arm, and a spring connecting to and extending between said base arm and one of said bottom arm and said top arm for outwardly biasing said bottom arm, said extended arm, and said top arm toward the extended position; and an electric motor operable to rotate said roller in either direction to automatically deploy and retract said awning assembly.

18. The retractable awning assembly according to claim 17, further comprising a torsion spring biasing said roller to roll said canopy onto said roller.

19. The retractable awning assembly according to claim 18, wherein said torsion spring is operably connected to one end of the roller and said electric motor is operably connected to the other end of said roller.

20. The retractable awning assembly according to claim 17, wherein said motor is operably connected to said roller with a gear train.

21. The retractable awning assembly according to claim 20, wherein said gear train includes an internal gear attached to said roller and a pinion gear attached to said motor and cooperable with said internal gear.

22. The retractable awning assembly according to claim 17, wherein said spring is a compression spring extending between said base arm and said top arm.

23. The retractable awning assembly according to claim 22, wherein said second spring is a gas spring.

24. The retractable awning assembly according to claim 17, each of said arm assemblies further include a push-off spring adapted to outwardly bias said extended arm when said arm assembly is near said retracted position.

25. The retractable awning assembly according to claim 24, wherein said push-off spring is a leaf spring.

26. The retractable awning assembly according to claim 24, wherein said push-off spring acts between said extended arm and said top arm.

27. The retractable awning assembly according to claim 17, wherein said bottom arm is tensioned to bias a lower end of the arm assembly to said retracted position when said arm assembly is near said retracted position.

28. The retractable awning assembly according to claim 27, wherein said bottom arm is spring biased.

29. The retractable awning assembly according to claim 17, wherein said spring is a gas spring.

30. A retractable awning assembly for mounting to a wall, said awning comprising:

a roller;

a flexible canopy rollable on said roller and having an inner edge for connection to the wall and an outer edge secured to said roller;

a torsion spring operably connected to a first end of the roller to bias said roller to roll said canopy onto said roller and said torsion spring tensions said canopy;

a pair of arm assemblies supporting opposite ends of said roller and operable to move said roller between a retracted position adjacent the wall and an extended position spaced from the wall, each of said arm assemblies including a vertically extending base arm for connection to the wall, a bottom arm having a first end pivotally connected to said base arm, an extended arm having a first end pivotally connected to said bottom arm and a second end connected to and supporting said roller, a top arm having a first end pivotally connected to said base arm above said bottom arm and a second end pivotally connected to said extended arm, and a gas spring connecting to and extending between said base arm and said top arm for outwardly biasing said bottom arm, said extended arm, and said top arm toward the extended position; and an electric motor operably connected to a second end of the roller with a gear train to selectively rotate said roller in either direction.

* * * * *